US009702216B2

(12) United States Patent
Larsen et al.

(10) Patent No.: US 9,702,216 B2
(45) Date of Patent: Jul. 11, 2017

(54) METHOD FOR ESTABLISHMENT OF AN ANNULUS BARRIER IN A SUBTERRANEAN WELL

(71) Applicant: Hydra Systems AS, Tananger (NO)

(72) Inventors: Arne Gunnar Larsen, Sandnes (NO); Patrick Andersen, Hafrsfjord (NO); Roy Inge Jensen, Stavanger (NO); Arnt Olav Dahl, Randaberg (NO); Morten Myhre, Tananger (NO)

(73) Assignee: Hydra Systems AS, Tananger (NO)

( * ) Notice: Subject to any disclaimer, the term of this patent is extended or adjusted under 35 U.S.C. 154(b) by 218 days.

(21) Appl. No.: 14/375,086

(22) PCT Filed: Jan. 21, 2013

(86) PCT No.: PCT/NO2013/050015
§ 371 (c)(1),
(2) Date: Jul. 28, 2014

(87) PCT Pub. No.: WO2013/115652
PCT Pub. Date: Aug. 8, 2013

(65) Prior Publication Data

US 2014/0367102 A1 Dec. 18, 2014

(30) Foreign Application Priority Data

Feb. 3, 2012 (NO) ..... 20120116

(51) Int. Cl.
*E21B 23/14* (2006.01)
*E21B 33/10* (2006.01)
(Continued)

(52) U.S. Cl.
CPC ..... *E21B 33/10* (2013.01); *E21B 33/13* (2013.01); *E21B 33/14* (2013.01)

(58) Field of Classification Search
CPC ... E21B 23/14; E21B 2033/105; E21B 43/112
(Continued)

(56) References Cited

U.S. PATENT DOCUMENTS 4,372,384 A 2/1983 Kinney
5,277,251 A 1/1994 Blount et al.
(Continued)

FOREIGN PATENT DOCUMENTS

NO 20111641 7/2012
WO 0070183 11/2000
(Continued)

OTHER PUBLICATIONS

International Search Report and Written Opinion for PCT/NO2013/050015 dated May 6, 2013.
(Continued)

*Primary Examiner* — Doug Hutton, Jr.
*Assistant Examiner* — Ashish Varma
(74) *Attorney, Agent, or Firm* — Andrus Intellectual Property Law, LLP

(57) ABSTRACT

A method is for establishing an annulus barrier in a subterranean well. The method comprises providing a plug in the well and along a longitudinal section thereof, wherein the plug, at least in a portion of the longitudinal section, covers substantially the entire cross-section of the well in such a manner that the plug covers both the inside and the outside of a casing; removing a central through portion of the plug internally in the casing in such a manner that a through central opening is formed in the plug, and in such a manner that at least a cross-sectional section of the plug remains on the outside of the casing; disposing and anchoring a connection pipe in the well, and internally in the casing, in such a manner that the connection pipe extends at least along a length of the remaining cross-sectional section; and sealing,
(Continued)

in a fluid-tight manner, an annulus between the casing and the connection pipe.

12 Claims, 16 Drawing Sheets

(51) Int. Cl.
*E21B 33/13* (2006.01)
*E21B 33/14* (2006.01)

(58) Field of Classification Search
USPC ..... 166/285
See application file for complete search history.

(56) References Cited

U.S. PATENT DOCUMENTS

| | | | | |
|---|---|---|---|---|
| 5,423,387 | A | 6/1995 | Lynde | |
| 5,431,219 | A | 7/1995 | Leising et al. | |
| 5,584,350 | A | 12/1996 | Schnitker et al. | |
| 2002/0162657 | A1* | 11/2002 | Tumlin | E21B 33/134 166/285 |
| 2009/0032257 | A1 | 2/2009 | Rayssiguier et al. | |
| 2010/0025036 | A1* | 2/2010 | Gambier | E21B 33/127 166/277 |

FOREIGN PATENT DOCUMENTS

| | | |
|---|---|---|
| WO | 2011074981 | 6/2011 |
| WO | 2012105852 | 8/2012 |
| WO | 2012128644 | 9/2012 |

OTHER PUBLICATIONS

International Preliminary Report on Patentability for PCT/NO2013/050015 dated Jan. 31, 2014.
Response to Written Opinion for PCT/NO2013/050015 dated Oct. 31, 2013.
International Search Report and Written Opinion for PCT/NO2013/050029 dated May 24, 2013.
Larsen, Ame G., Hydrawash (TM)—a new approach to get cement behind casing without milling. P&A Forum Workshop, Jun. 9, 2011, Sola, Norway.
Ferg, T.E., et al., "Novel Approach to More Effective Plug and Abandonment Cementing Techniques," SPE Arctic and Extreme Environments conference and Exhibition, SPE 148640, Oct. 2011: 1-13.

* cited by examiner

METHOD FOR ESTABLISHMENT OF AN ANNULUS BARRIER IN A SUBTERRANEAN WELL

CROSS-REFERENCE TO RELATED APPLICATIONS

This application is the U.S. national stage application of International Application PCT/NO2013/050015, filed Jan. 21, 2013, which international application was published on Aug. 8, 2013, as International Publication WO2013/115652 in the English language. The international application is incorporated herein by reference, in entirety. The international application claims priority to Norwegian Patent Application No. 20120116, which is incorporated herein by reference.

FIELD

The invention concerns a method for establishment of an annulus barrier in a subterranean well. More specifically, the invention concerns establishment or re-establishment of a permanent barrier plug in an annulus around a casing in a subterranean well. A plug is set across the entire cross-section of the well, after which a central portion of the plug is drilled out to reopen the well path whilst a cross-sectional portion of the plug remains around the casing and forms a barrier in the annulus.

BACKGROUND

In context of construction and completion of a subterranean well, stringent safety requirements are imposed on the responsible party. It is important to protect personnel, the surrounding environment and also drilling- and production equipment from the formations being intervened. High pressure- and temperature differences may challenge the work carried out in the well. Well barriers are loops having one or more cooperating well barrier elements which prevent fluids from flowing in an undesirable manner from the formation, either into another formation or up to surface. In accordance with NORSOK standard D-010 (« Well integrity in drilling and well operations »), one barrier loop is required in a well exposed to dangers of uncontrolled cross flows between the formation zones in the well, whereas two barrier loops are required in a well exposed to dangers of uncontrolled blowouts from the well and into the environment. Intact barrier loops are prerequisites for allowing the work to be carried out in accordance with the standard, and at no or minimum risk of undesireable events taking place. Various forms of plugs, oftentimes made of cement, may be important well barrier elements both in primary and secondary barrier loops. In accordance with the standard, at least 100 meters of cement or another suitable plugging material is required, among other things, to be present from the casing shoe, which is located at a lower portion of a casing, and upwards within the annulus around the casing. It is known for the integrity of the annulus plug to become damaged due to weak formations, or due to impurities in the annulus preventing good circulation and adhesion of the plugging material, and also due to poor quality of the very plugging material, among other things, whereby the plugging material does not satisfy the sealing requirement after some time. Typically, substantial pressure increases in the various annuli in the well will be indications of a "poor cement job". Both old and new wells may have to be drilled out again to evade the problems of poor or difficult barrier plugs, which will incur substantial additional costs to an operator.

SUMMARY

The object of the invention is to remedy or reduce at least one of the disadvantages of the prior art, or at least to provide a useful alternative to the prior art.

The object is achieved by virtue of features disclosed in the following description and in the subsequent claims.

More specifically, the invention concerns a method for establishment of an annulus harrier in a subterranean well, wherein the well, at least in a portion where the annulus barrier is to be established, is provided with a casing, and wherein the method is characterized in that it comprises the following steps:

(A) providing a plug in the well and along a longitudinal section thereof, wherein the plug, at least in a portion of the longitudinal section, covers substantially the entire cross-section of the well in such a manner that the plug covers both the inside and the outside of the casing;

(B) removing a central through portion of the plug internally in the casing in such a manner that a through central opening is formed in the plug, and in such a manner that at least a cross-sectional section of the plug remains on the outside of the casing;

(C) disposing and anchoring a connection pipe in the well, and internally in the casing, in such a manner that the connection pipe extends at least along a length of the remaining, cross-sectional section; and (D) sealing, in a fluid-tight manner, an annulus between the casing and the connection pipe.

For example, the plug may be established by means of a method and devices as disclosed in Norwegian patent application 20111641 bearing the title "Method for combined cleaning and plugging in a well, a washing tool for directional washing, and use of the washing tool", and in Norwegian patent application 20110450 bearing the title "Apparatus for positive drive of liquid, permanent plugging material through a perforated casing in oil or gas wells", both of which have been filed by the present applicant.

For example, the casing may be perforated by means of a perforation tool in a manner described in the above-mentioned patent publication NO 20111641, or the casing may be severed, cut or drilled by means of prior art known per se to render plugging of the well possible across substantially the entire cross-section of the well.

In a first embodiment, the method, before step (A), may further comprise a step of sealing, in a fluid-tight manner, the longitudinal section where the plug is to be set from a fluid-producing part of the well. This will be appropriate if an annulus barrier is to be re-established in an already-producing oil well, and this may be carried out e.g. in context of setting a sealing element in fluid-sealing engagement with a casing, a liner, or similar member, above the producing formation, and in such a manner that the longitudinal section of the well where the annulus barrier is to be established is not exposed to flowing fluids during the establishment process. The sealing element may be of a type known per se.

In a second embodiment, the method, before step (A), may further comprise a step of removing one or more pipe bodies in the well from the longitudinal section where the plug is to be set. Such pipe bodies may be e.g. production tubings of various types. This will be appropriate in order to establish a plug in an already-producing well given that unnecessary pipe bodies, which potentially may damage or weaken the plug, are removed from the area where the plug is to be established.

In a third embodiment, the method may further comprise a step of disposing and anchoring a plug base in the well below the longitudinal section where the plug is to be set. This may prove appropriate in an already-established well path requiring a base for determining the placement of the plug in the well. For example, the plug base may be a sealing element of a type known per se. It may be of advantage for the plug base to be of a drillable material.

In an embodiment of the method, step (D) may include filling the annulus between the connection pipe and the casing with a fluidized plugging material. This may contribute to re-establish the integrity of the casing as a barrier element given that the casing may be damaged on purpose or not, for example during perforation, in context of forming a plug and annulus barrier. For example, the fluidized plugging material may be cement slurry or a particulate mass, usually of the same type which is used to form the annulus barrier.

In a further embodiment of the method, step CD) may include setting at least one of an upper and a lower connection seal (tie-back packer) in fluid-sealing engagement between the casing and the connection pipe. This may be carried out instead of, or in addition to, filling the annulus with a fluidized plugging material. The connection seals may be sealing elements of types known per se.

In one embodiment, the method, before step (A), may comprise a step of conducting a pre-perforated casing down into the well. This may prove appropriate in an embodiment where an annulus barrier is to be established in a well being constructed. The casing may then be perforated at surface before being lowered down into the well. For example, the perforation may be carried out by means of a severing, cutting or drilling tool, or by means of a perforation tool.

In one embodiment, the method, after step (B), may further comprise a step of drilling out a well path in an extension of a lower portion of the casing. This may be appropriate if an annulus barrier is to be established in a well being drilled out. The drilling out of new formation may take place before step (C). The connection pipe, which is disposed and anchored in the casing in step (C) of the method, may thus extend down into the new formation being drilled out.

In one embodiment, step (A) may include the following sub-steps:

(A1) conducting a perforation tool down into the casing and to the longitudinal section where the plug is to be set;

(A2) forming holes in the casing along the longitudinal section by means of the perforation tool;

(A3) by means of a washing tool, which is attached to a flow-through string and is conducted down to the longitudinal section, pumping a washing fluid down through the string and out into the casing via the washing tool;

(A4) by means of a directional means connected to the washing tool, conducting the washing fluid out into (e.g. radially out into) an annulus between the outside of the casing and a surrounding formation; and (A5) pumping a fluidized plugging material down through the string and out into the casing, thus also into the annulus via said holes in the casing.

It may be of advantage to use a displacement body in the form of a pressing apparatus, as described in said Norwegian patent application 20110450, to further displace and distribute the fluidized plugging material in the casing and further out into the annulus.

The washing tool may be releasably connected to the string.

In one embodiment, the steps of perforating and washing may be carried out in separate trips down into the well.

In another embodiment, the steps of perforating and washing may be carried out in one and the same trip down into the well. This, for example, may be carried out in the manner described in the above-mentioned Norwegian patent publication 20111641, and by virtue of the perforation tool and the washing tool being connected to the same string. The perforation tool may also be releasably connected to the washing tool.

In one embodiment, the method may further comprise a step of leaving the perforation tool in the well. This may prove particularly appropriate if the perforation tool is drillable and/or may be left in a suitable place in the well.

In another embodiment, the method may comprise a step of leaving the washing tool in the well. This may prove particularly appropriate if the washing tool is drillable and/or may be left in a suitable place in the well.

In yet another embodiment, the method may further comprise a step of completing the well, with production equipment.

BRIEF DESCRIPTION OF THE DRAWINGS

Hereinafter, examples of embodiments are described and are depicted in the accompanying drawings, where.

DETAILED DESCRIPTION OF THE DRAWINGS

Figure 1:
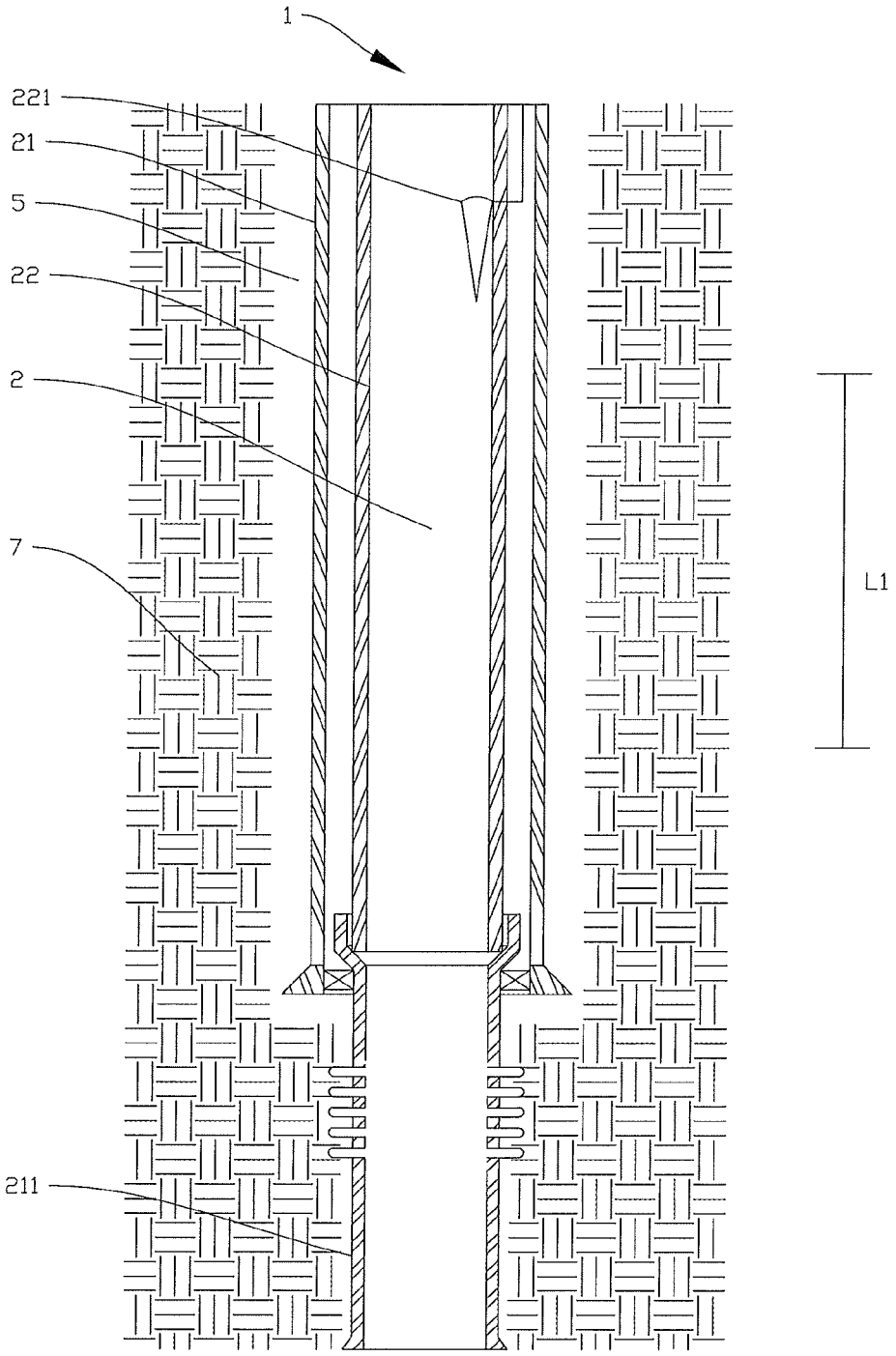
FIGS. 1 to 11 show, as viewed from the side, simplified and schematic sections of a well at different stages, and in accordance with a first embodiment of the method of the present invention.

In the following, reference numeral 1 denotes a subterranean well as used in context of the method of the present invention. The well 1 is depicted in a simplified and schematic manner, and elements not being central to the invention may be left out from the Figures. A casing 21 extends down into the well 1 and forms an outer, radial demarcation between a well path 2 and a surrounding formation 7. The object of the method of the present invention is to establish a barrier 51 in an annulus 5 between the casino 21 and the surrounding formation 7, and within a longitudinal section L1. This may concern re-establishment of an annulus barrier 51 in an already-constructed well 1, as shown in FIGS. 1 to 11, or establishment of an annulus barrier 51' in a well 1 being constructed, as shown in FIGS. 12 to 16.

In FIG. 1, an already-constructed well 1 is shown. A pipe body 22 in the form of a production tubing 22 extends down into the well 1, and internally in the casing 21, and enters into fluid-sealing engagement with a perforated production liner 211, which extends down into a producing part of the formation (the reservoir) 7. For reasons of safety, a valve device 221 of a type known per se has been set internally in the pipe body 22.

Figure 2:
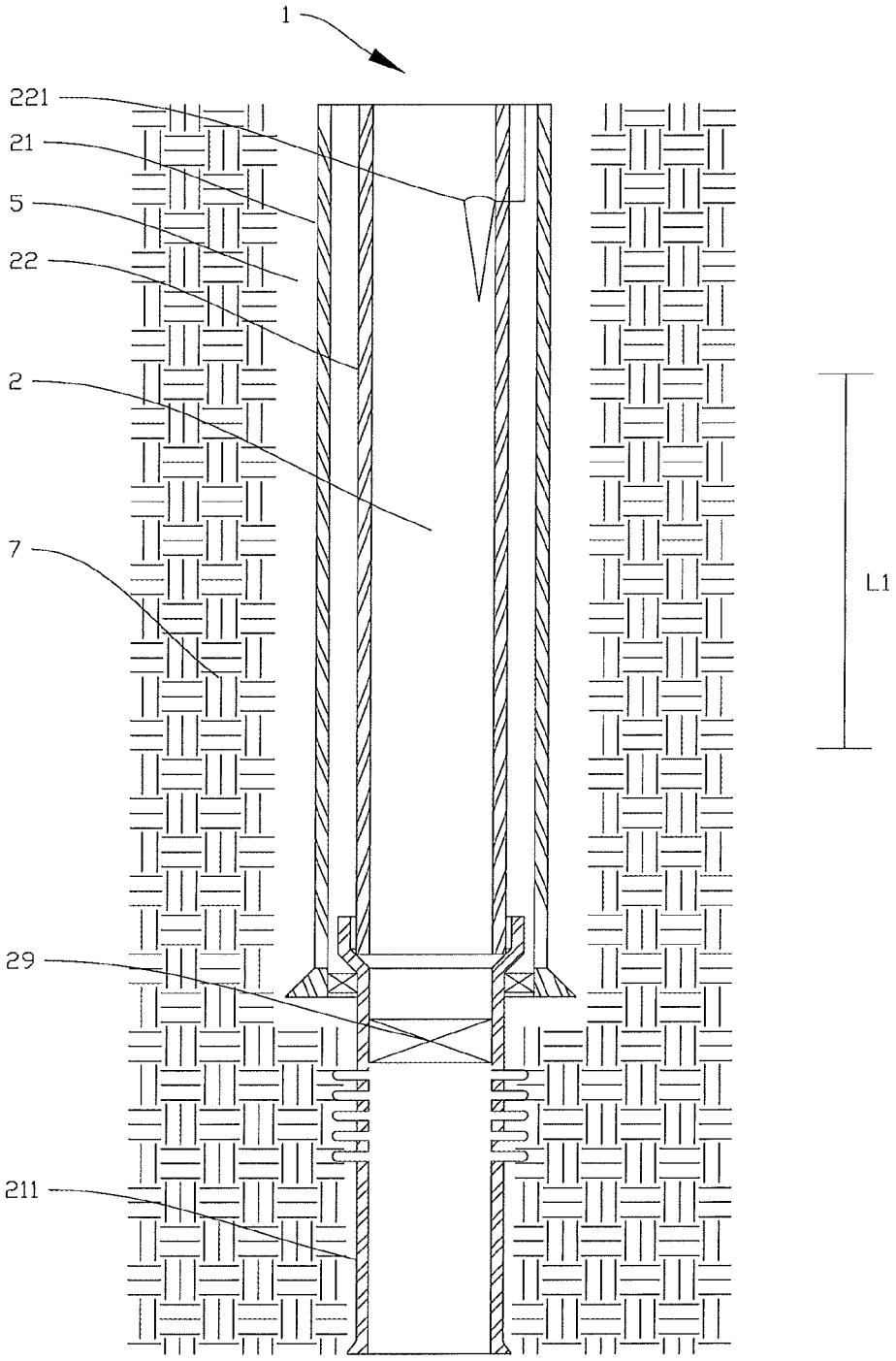
Figure 3:
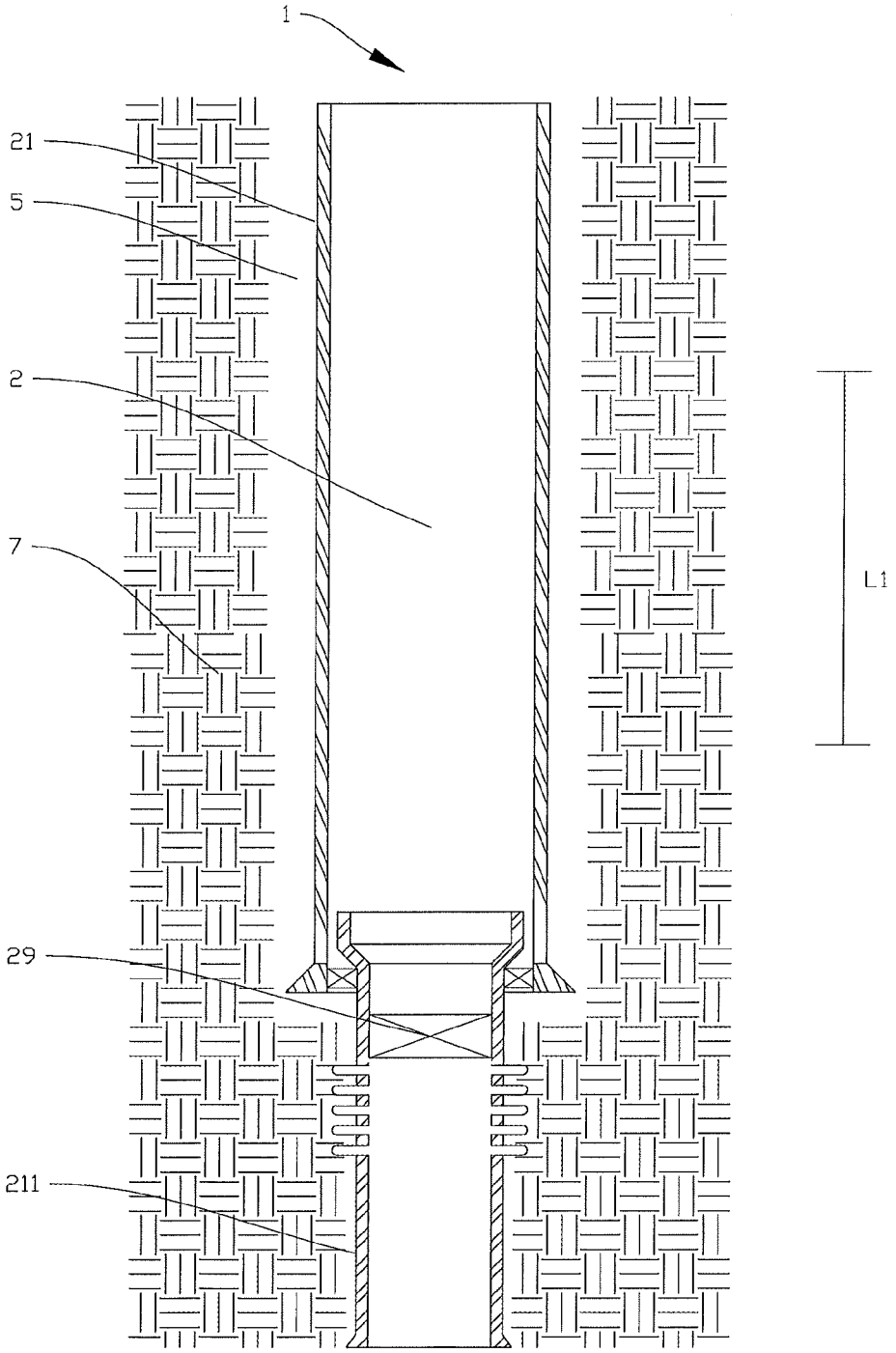

FIG. 2 shows the well after having set a sealing element 29 in fluid-sealing engagement with the inside of the production liner 211, whereby fluids (not shown) from the reservoir are prevented from flowing up into the well 1 when the operation of establishing the annulus barrier 51 is ongoing. FIG. 3 shows the well after having removed the production tubing 22 and the valve device 221 from the well 1, whereby the well path 2 has been prepared for establishment of a plug 25.

Figure 4:
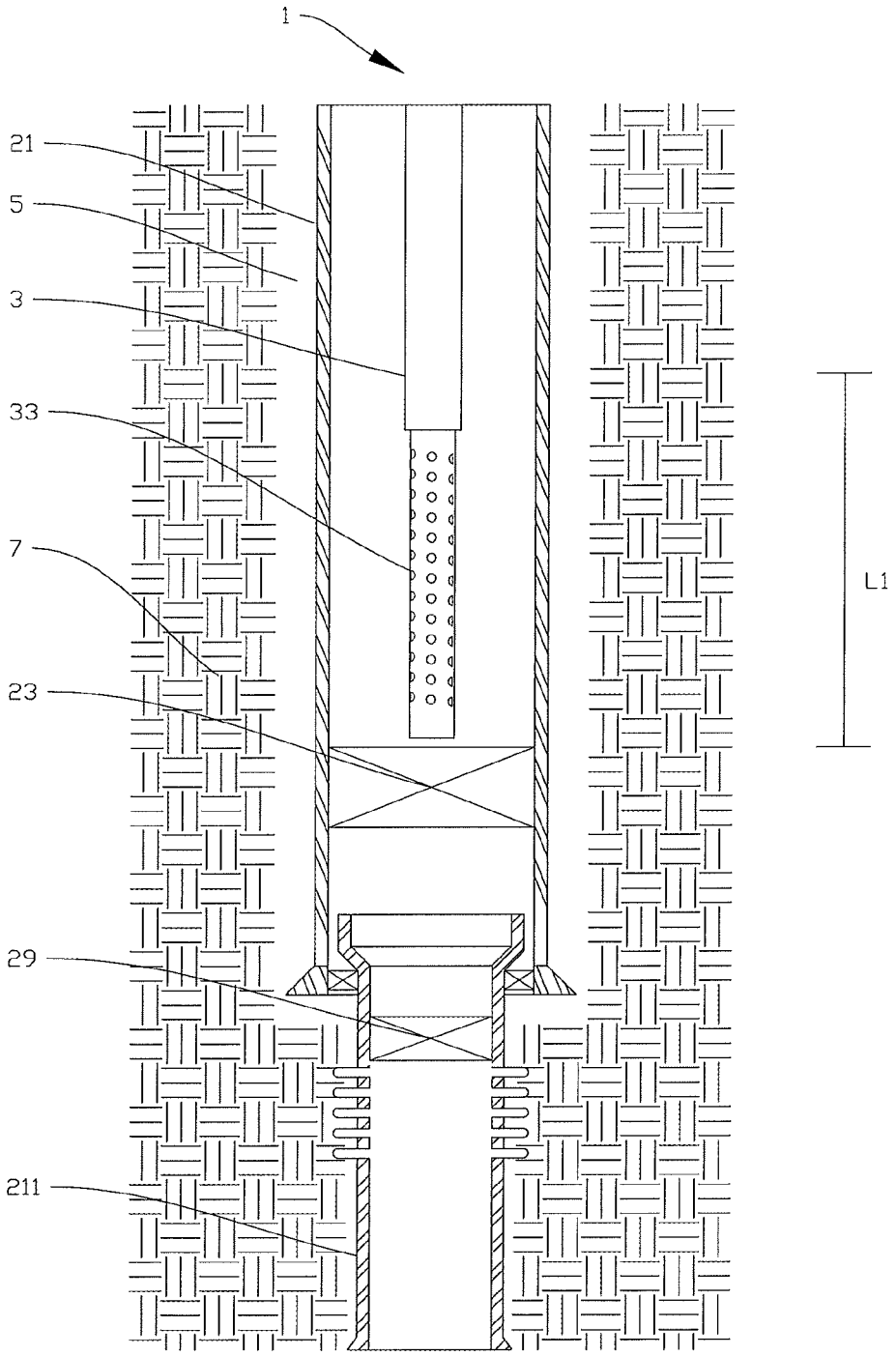
Figure 5:
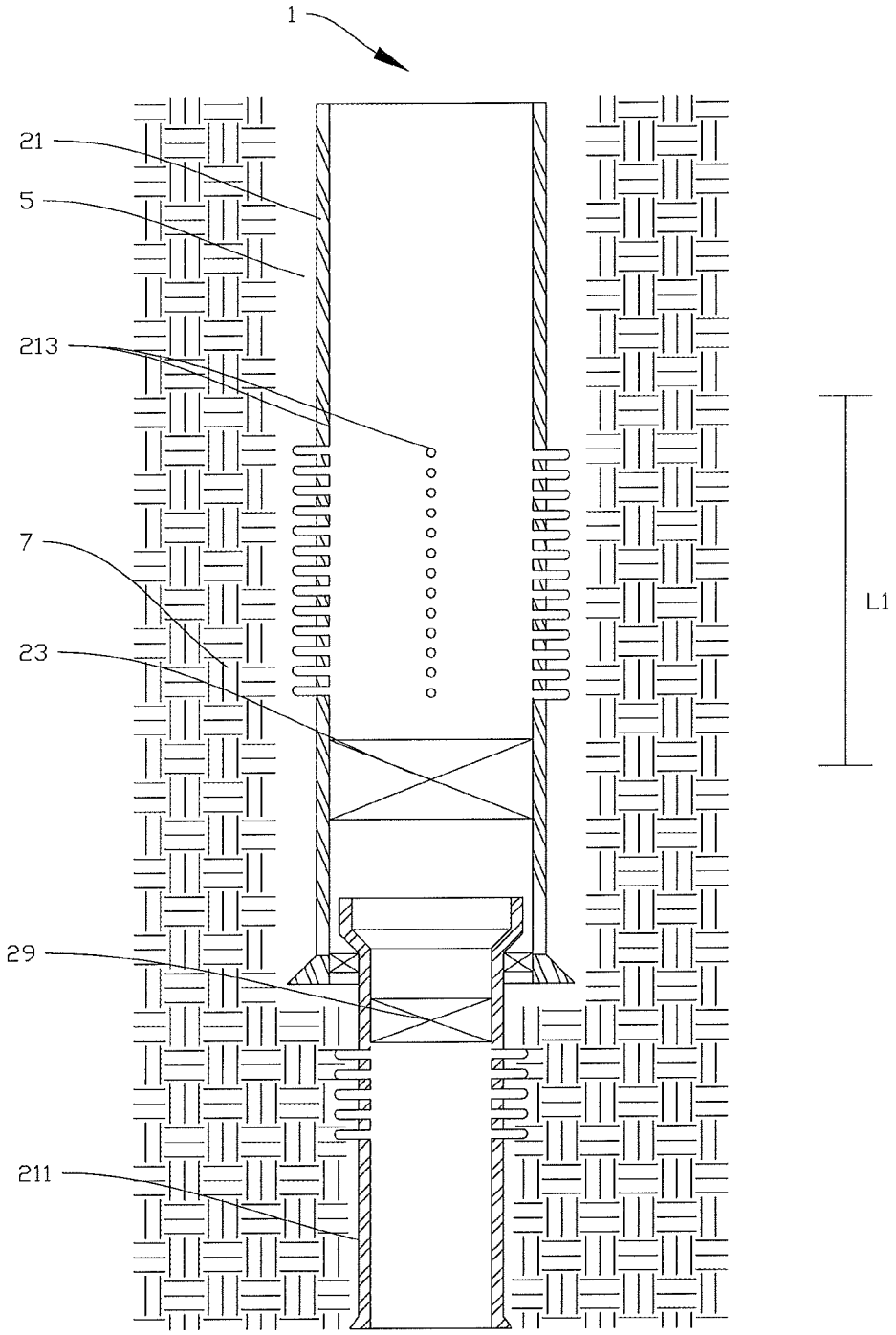

A perforation tool 33 is then conducted down into the well 1 on a string 3, and internally in the casing 21, and is placed along the longitudinal section L1 where the plug is to be established, as shown in FIG. 4. A plug base 23 has been set in the well 1 and in engagement with the inside of the casing 21 below the longitudinal section L1 for the purpose of determining the placement of the plug 25 in the well 1. The perforation tool 33 is then used to form holes 213 in the casing 21 along the longitudinal section L1, as shown in FIG. 5 with the perforation tool 33 withdrawn from the well 1.

Figure 6:
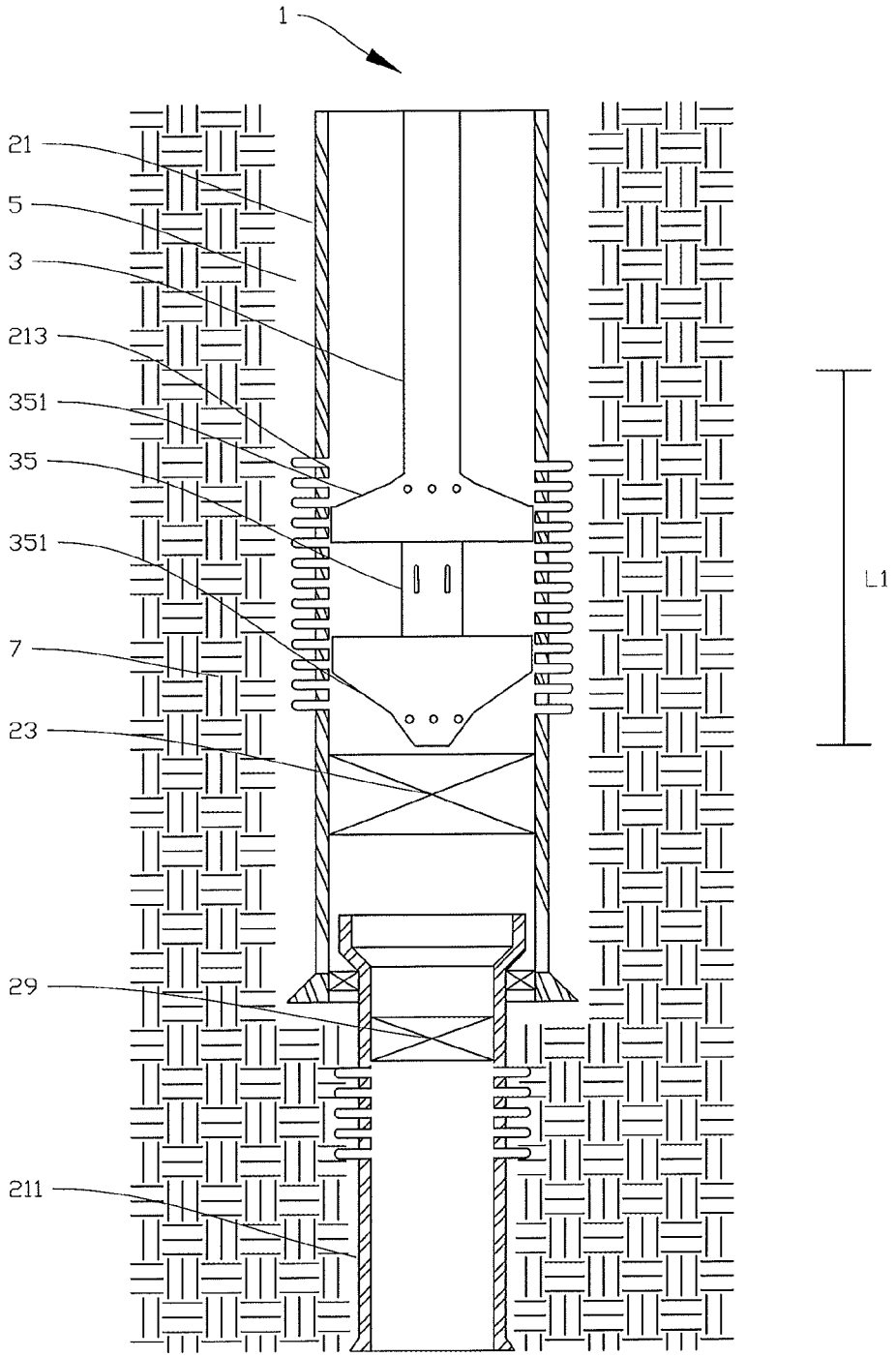
Figure 7:
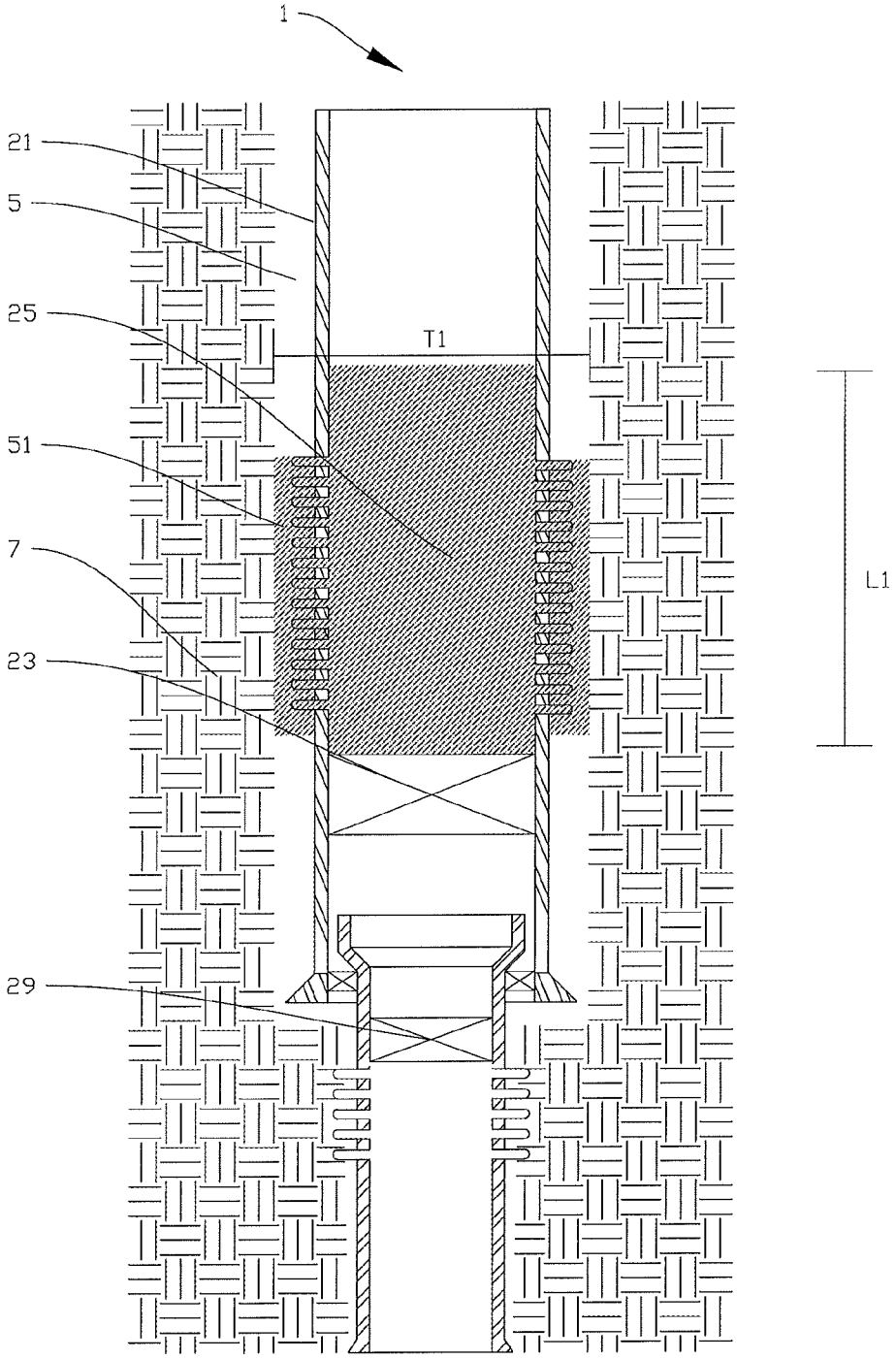

A combined washing and plugging tool 35 is then conducted down into the well 1 and within the casing 21, as shown in FIG. 6. Perforating and washing and plugging may be carried out in the same trip or in separate trips down into the well 1. A washing fluid (not shown) is conducted through the string 3, out into the casing 21, and further out into the annulus 5 via the holes 213. It may be of advantage for the washing fluid to be directed radially out into the annulus 5 by means of a directional means 351, as described in Norwegian patent application 20111641. A washing fluid at high velocity will be able to remove various particles, deposits and remnants from previous down-hole operations, whereby the plugging material, which is to be conducted into the annulus 5 at a later stage, may flow freely and be adhered in a better way. Then a fluidized plugging material is pumped through the string 3 and out into the casing 21 at the upper side of the plug base 23 in the well path 2, and further out into the annulus 5 via the holes 213 in the casing 21, whereby a plug 25 is formed along the longitudinal section L1 as shown in FIG. 7. The plug 25 extends, at least in a portion within the longitudinal section L1, across the entire cross-section T1 of the well 1. It may be of advantage to use an apparatus of the type described in Norwegian patent application 20110450 to further displace and distribute the fluidized plugging material in the casing 21 and out into the annulus 5. The latter apparatus is not shown in the Figures associated with the present document.

Figure 8:
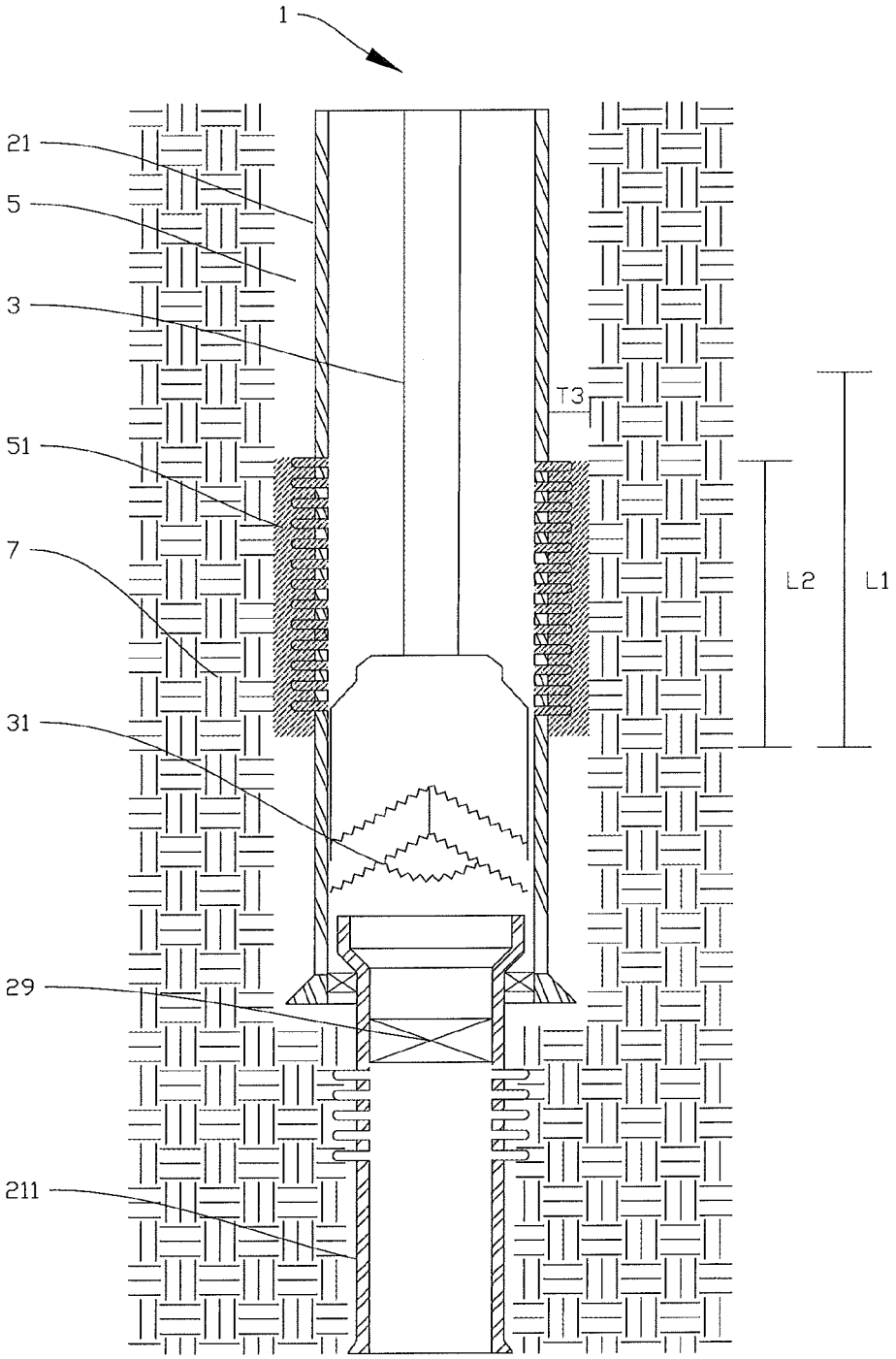

In FIG. 8, the well 1 is shown after having drilled away a central through portion of the plug 25 and the plug base 23 by means of a drilling tool 31. A cross-sectional section T3 of the plug 25, the section of which has a longitudinal section L2 outside the casing 21, remains within the longitudinal section L1. The remaining cross-sectional section T3 of the plug 25 outside the casing forms a barrier 51 in the annulus 5 between the casing 21 and the formation 7, and along a longitudinal section L2 thereof.

Figure 9:
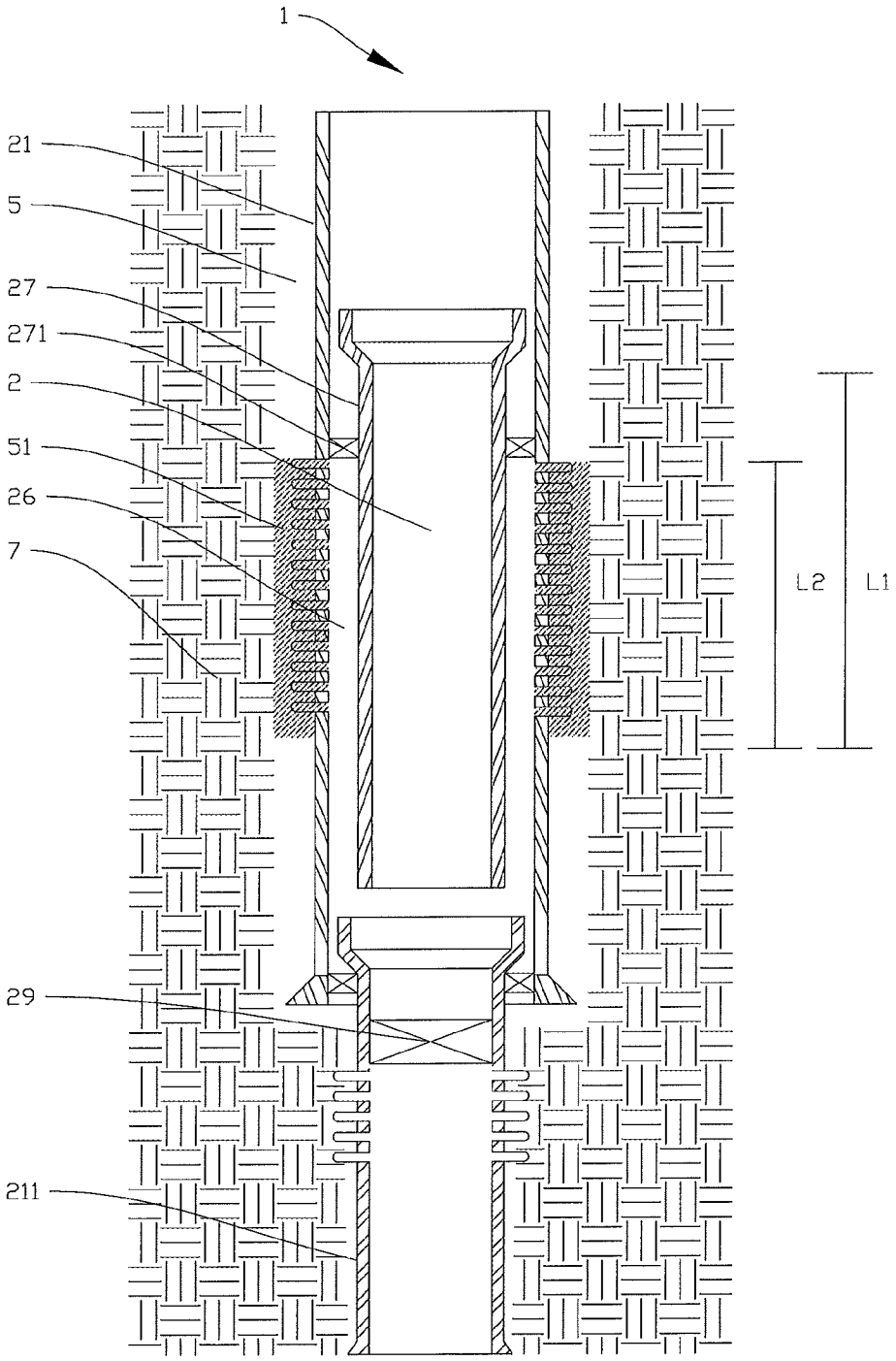
Figure 10:
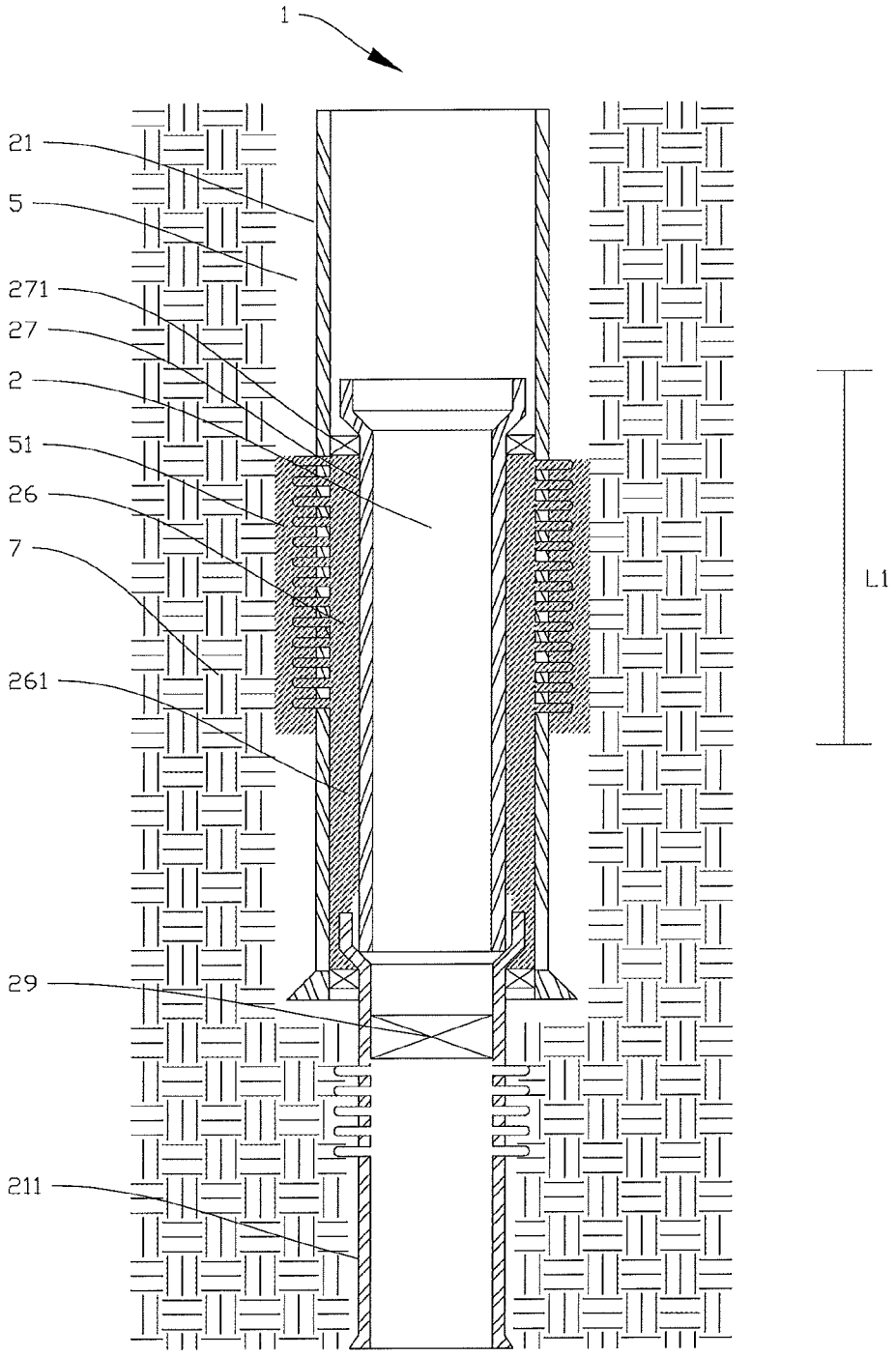

The holes 213 in the casing 21 imply that the integrity of the casing 21 no longer is ensured. For this reason, a connection pipe 27 is disposed and anchored within the casing 21, at least along the longitudinal section L2 where the casing 21 is perforated, as shown in FIG. 9. An upper connection seal 271 has been set in fluid-sealing engagement between the casing 21 and an upper portion of the connection pipe 27, and an annulus 26 between the connection pipe 27 and the casing 21 is filled by a fluidized plugging material for formation of an annulus seal 261 in a manner known per se. In the embodiment shown, the annulus 26 between the connection pipe 27 and the casing 21 is sealed further by virtue of displacing the connection pipe 27 downward to sealing engagement with the production liner 211, as shown in FIG. 10. Alternatively, a lower connection seal (not shown) could also be set in fluid-sealing engagement between the casing 21 and a lower portion of the connection pipe 27.

Figure 11:
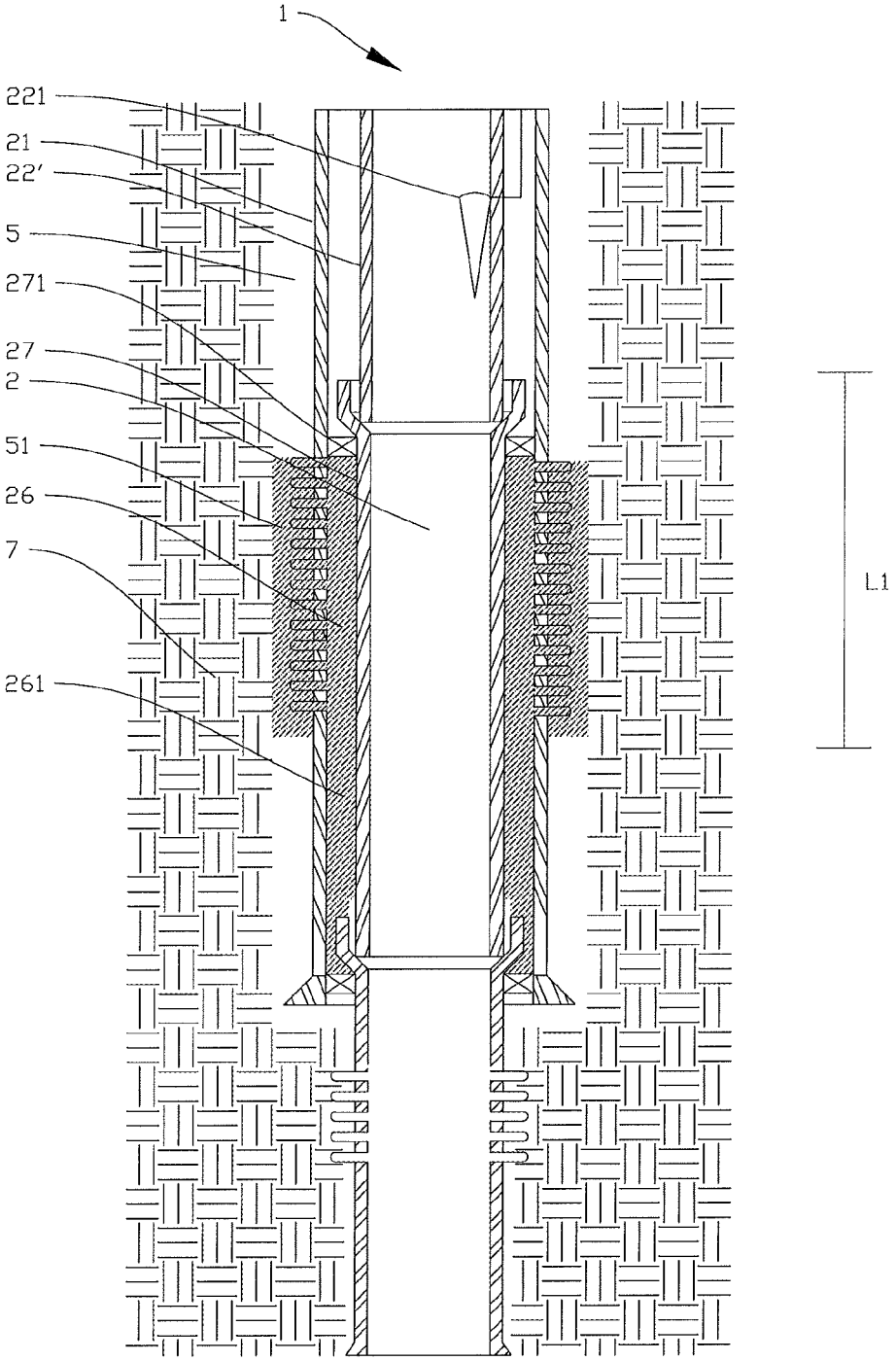

FIG. 11 shows the well 1 after having set a new pipe body 22', in the form of a production tubing, in fluid-sealing engagement with the connection pipe 27, and the seal ing element 29 has been removed from the production liner 211, whereby the well 1 once again is prepared for production.

Figure 12:
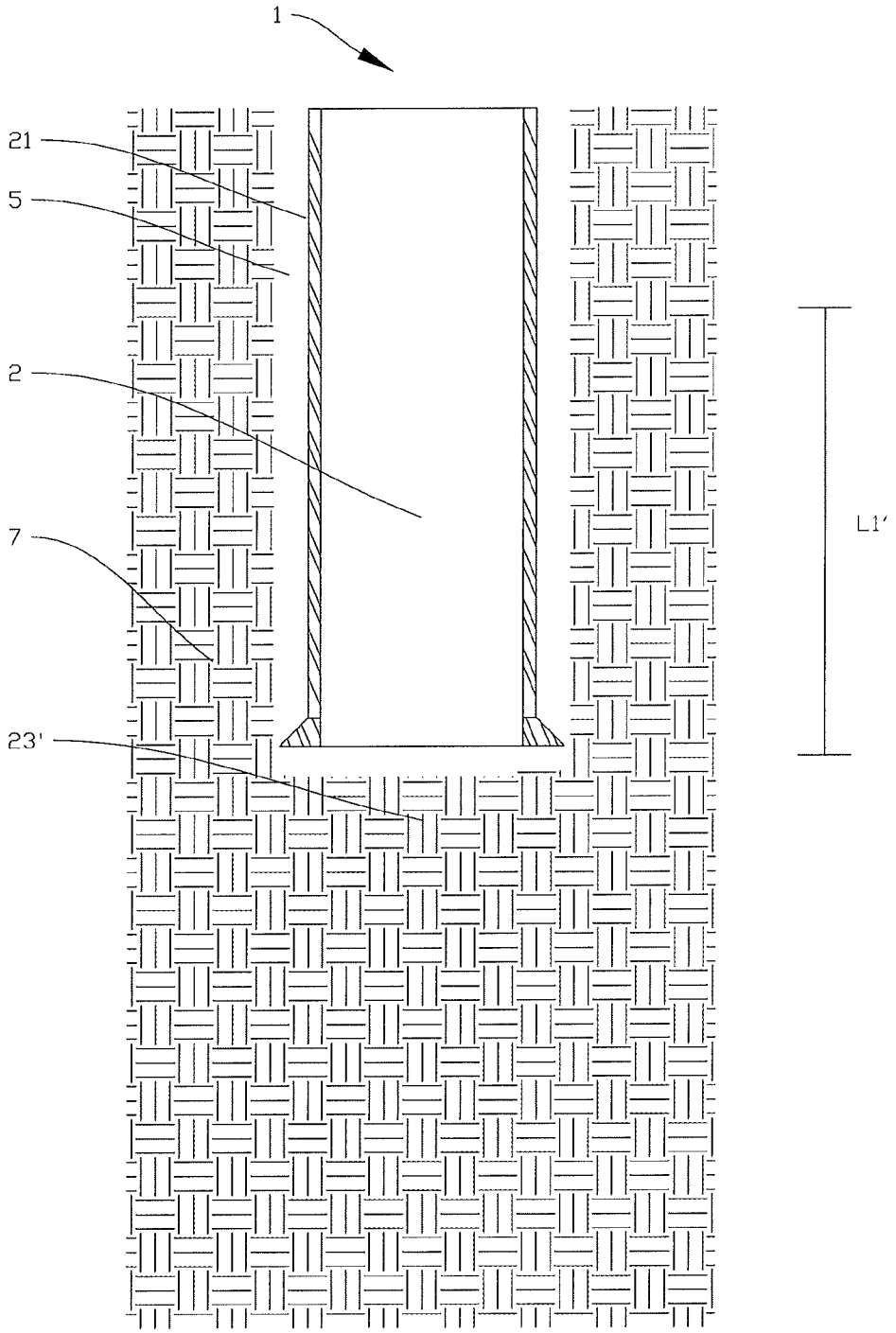
FIGS. 12 to 16 show, as viewed from the side, simplified and schematic sections of a well at different stages, and in accordance with a second embodiment of the method of the present invention.
Figure 13:
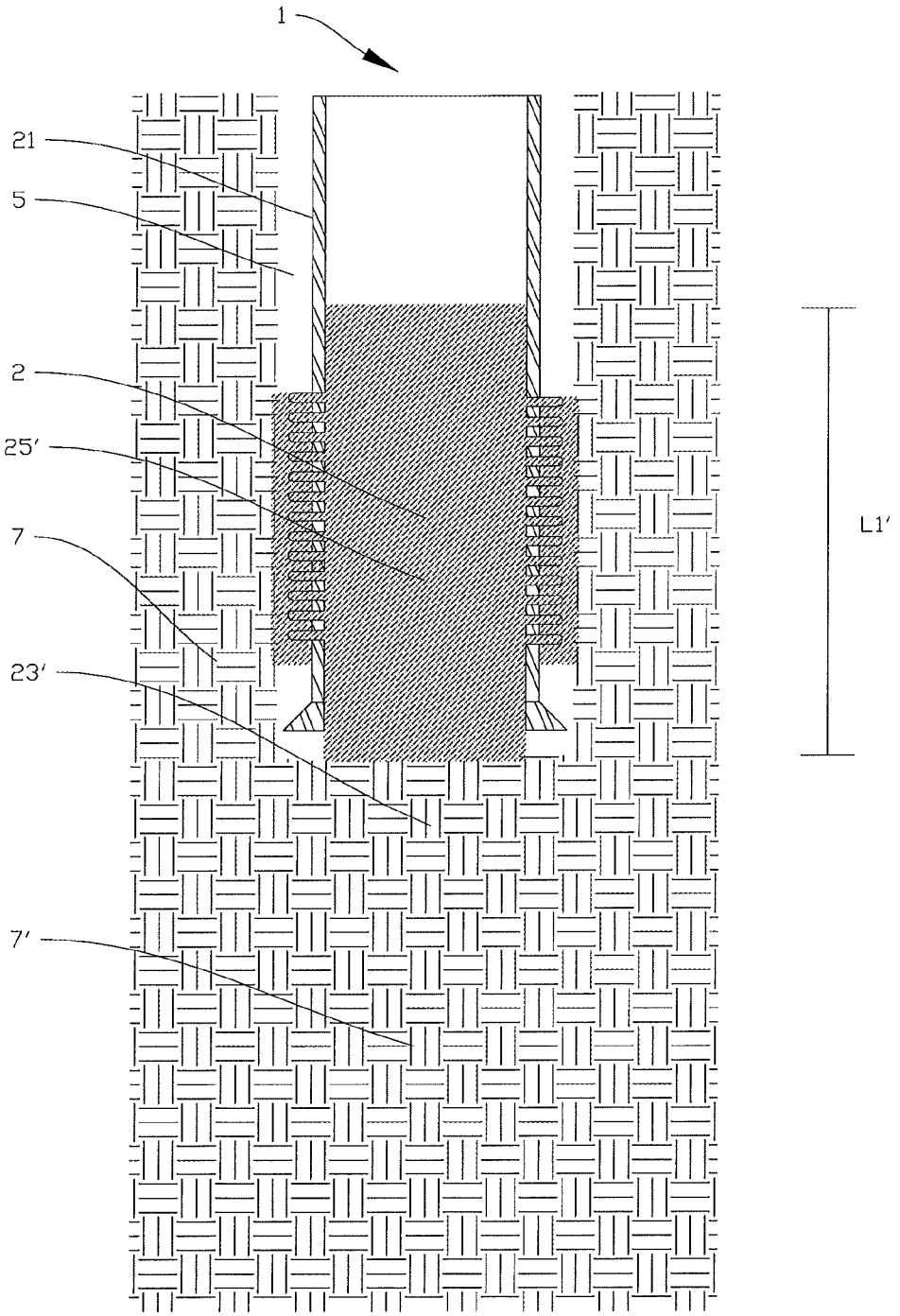
Figure 14:
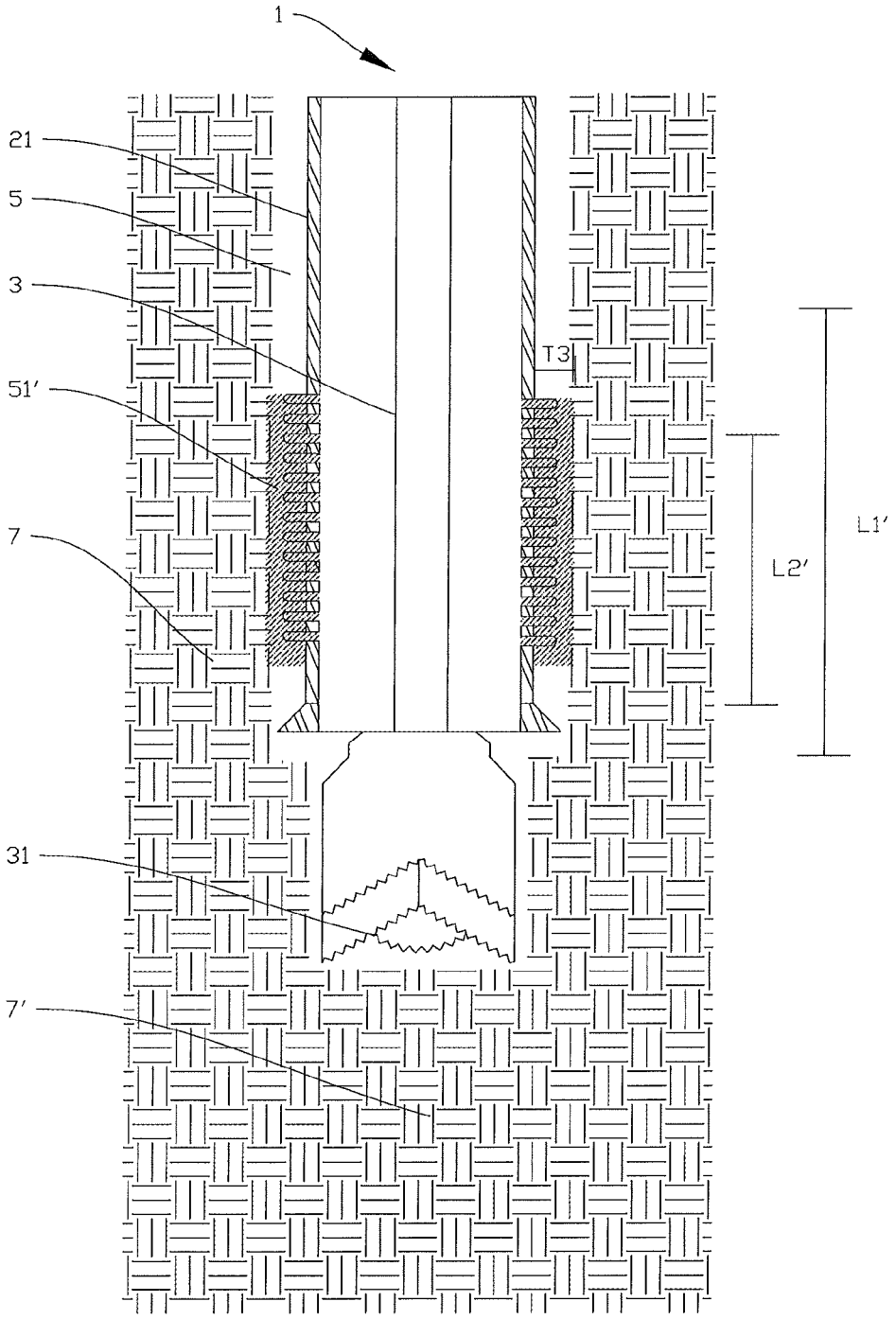
Figure 15:
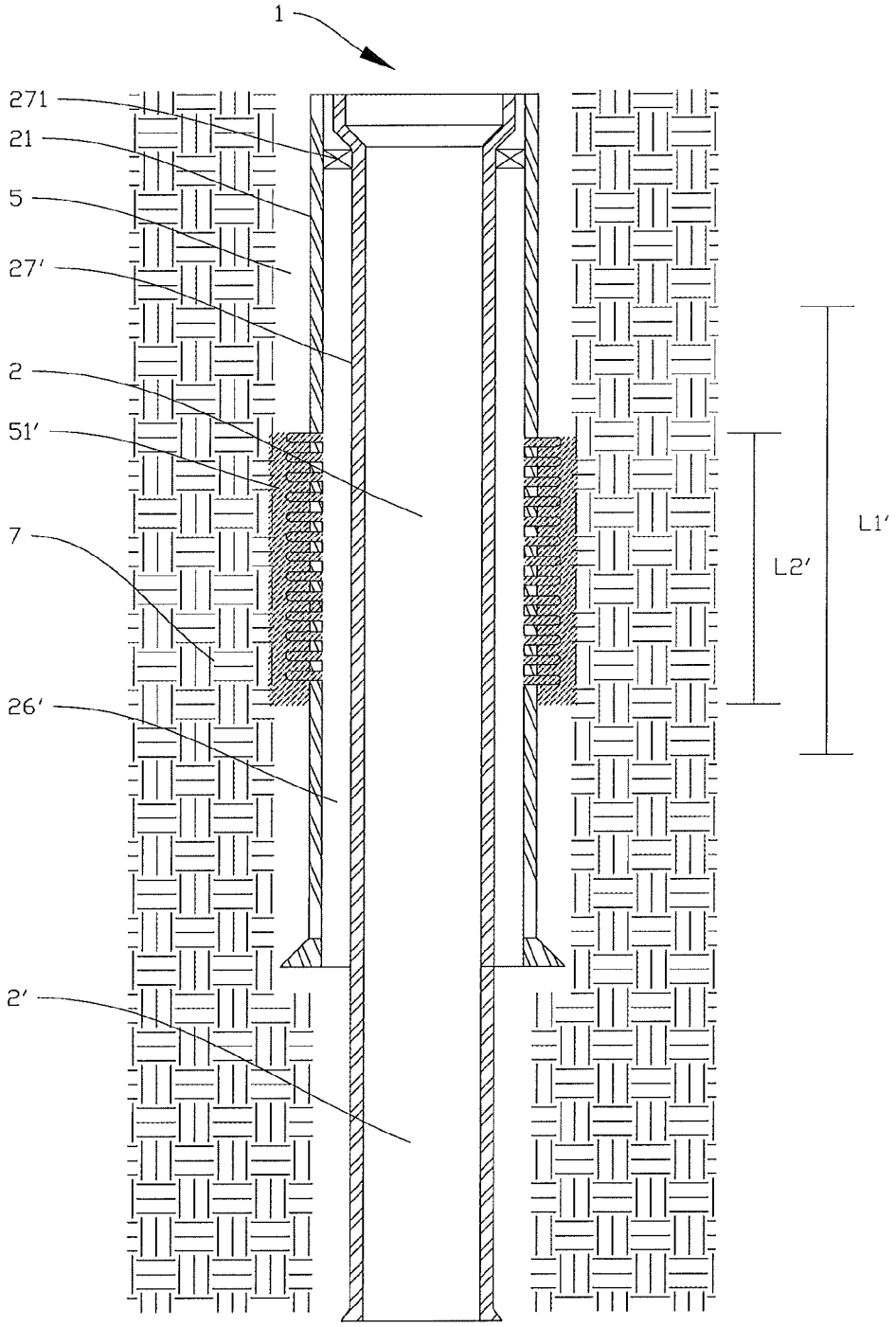
Figure 16:
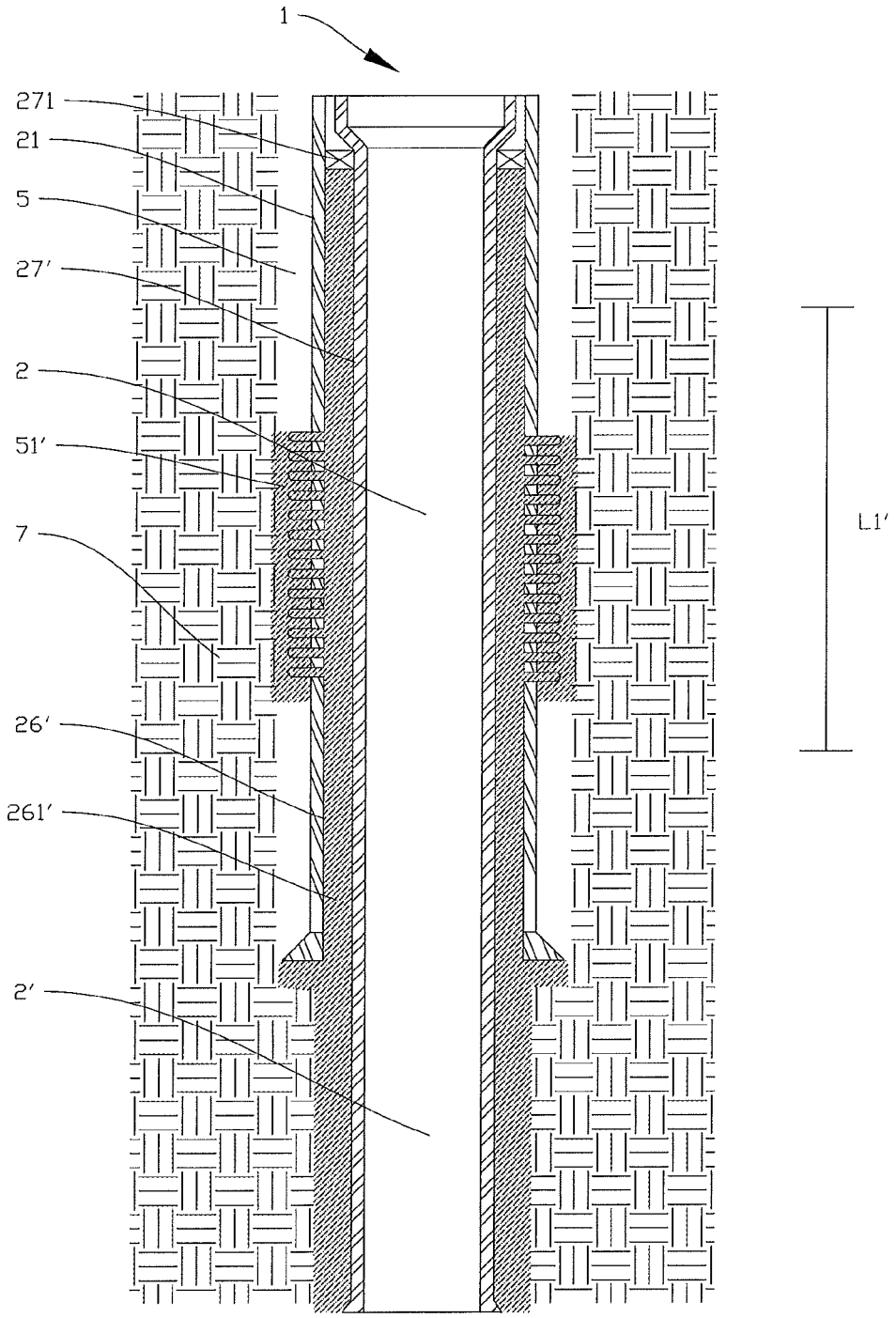

FIG. 12 shows an incompletely constructed well 1 where a barrier 51' is to be established in the annulus 5 between the casing 21 and the formation 7. A plug 25' is set along a longitudinal section L1' thereof, and an annulus barrier 51' is provided along a longitudinal section L2' by means of steps corresponding to those shown in FIGS. 4-8. A formation 7' at the bottom of the well path 2 is used as a plug base 23', as shown in FIG. 13. The plug 25' is drilled out, as shown in FIG. 14, and a new well path 2' is drilled out during the same operation. A connection pipe 27' is set in the well, as shown in FIG. 15. The connection pipe 27' extends internally in the casing 21, and from a portion above the longitudinal section L1' and down into the new well path 2'. An annulus 26' between the casing 21 and the connection pipe 27' is filled by a fluidized plugging material for formation of an annulus seal 261' in a manner known per se. The annulus seal 261' may also extend further downward in the annulus 26' formed between the connection pipe 27' and the formation 7', as shown in FIG. 16.

The invention claimed is:

1. A method for establishment of an annulus barrier in a subterranean well, wherein the well, at least in a portion where the annulus barrier is to be established, is provided with a casing, wherein the method comprises:

(A) providing a plug in the well and along a longitudinal section thereof, wherein the plug, at least in a portion of the longitudinal section, covers substantially the entire cross-section of the well in such a manner that the plug covers both the inside and the outside of the casing;

(B) removing a central through portion of the plug internally in the casing in such a manner that a through central opening is formed in the plug, and in such a manner that at least a cross-sectional section of the plug remains on the outside of the casing;

(C) disposing and anchoring a connection pipe in the well, and internally in the casing, in such a manner that the connection pipe extends at least along a length of the remaining cross-sectional section; and (D) sealing, in a fluid-tight manner, a first annulus between the casing and the connection pipe, wherein (A) comprises:

(A1) conducting a perforation tool down into the casing and to the longitudinal section where the plug is to be set;

(A2) with the perforation tool, forming holes in the casing along the longitudinal section;

(A3) with a washing tool, which is attached to a flow-through string and is conducted down to the longitudinal section, pumping a washing fluid down through the string and out into the casing via the washing tool;

(A4) with a directional means connected to the washing tool, conducting the washing fluid out into a second annulus between the outside of the casing and a surrounding formation; and (A5) pumping a fluidized plugging material down through the string and out into the casing, thus also into the second annulus via the holes in the casing.

2. The method according to claim 1, wherein the method, before (A), further comprises sealing, in a fluid-tight manner, the longitudinal section where the plug is to be set from a fluid-producing part of the well.

3. The method according to claim 1, wherein the method, before (A), further comprises removing one or more pipe bodies in the well from the longitudinal section where the plug is to be set.

4. The method according to claim 1, wherein the method further comprises disposing and anchoring a plug base in the well below the longitudinal section where the plug is to be set.

5. The method according to claim 1, wherein (D) comprises filling the first annulus between the connection pipe and the casing with a fluidized plugging material.

6. The method according to claim 1, wherein (D) comprises setting at least one of an upper and a lower connection seal in fluid-sealing engagement between the casing and the connection pipe.

7. The method according to claim 1, wherein the method, after (B), further comprises drilling out a well path in an extension of a lower portion of the casing.

8. The method according to claim 1, wherein a displacement body is used to further displace and distribute the fluidized plugging material in the casing and further out into the second annulus via the holes.

9. The method according to claim 1, wherein (A2) and (A3, A4) are carried out in separate trips down into the well.

10. The method according to claim 1, wherein the (A2) and (A3, A4) are carried out in one and the same trip down into the well.

11. The method according to claim 1, wherein the method further comprises leaving the perforation tool in the well.

12. The method according to claim 1, wherein the method further comprises leaving the washing tool in the well.

* * * * *